US006392763B1

(12) United States Patent
Nishinohara et al.

(10) Patent No.: US 6,392,763 B1
(45) Date of Patent: May 21, 2002

(54) SHEET FEEDING APPARATUS AND IMAGE FORMING APPARATUS

(75) Inventors: Takayuki Nishinohara, Toride; Atsushi Saito, Abiko; Fumihiko Nakamura, Tokyo; Noriyuki Aoki, Toride, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/154,517

(22) Filed: Sep. 16, 1998

(30) Foreign Application Priority Data

Sep. 19, 1997 (JP) ..... 9-254640

(51) Int. Cl.[7] ..... H04N 1/21
(52) U.S. Cl. ..... 358/496; 271/10.11
(58) Field of Search ..... 271/118, 220, 271/265, 227, 258, 186, 246, 10.11, 121, 124, 10.9; 358/474, 498, 496, 308, 400, 488

(56) References Cited

U.S. PATENT DOCUMENTS 4,606,536 A 8/1986 Ohara ..... 271/118
4,674,736 A * 6/1987 Tsubo ..... 271/122
4,791,457 A 12/1988 Shida ..... 355/3 SH
5,228,671 A 7/1993 Fish et al. ..... 271/9
5,915,684 A * 6/1999 Nakagawa ..... 271/122
5,983,066 A * 11/1999 Abe ..... 399/394
5,984,298 A * 11/1999 Wada ..... 271/121

FOREIGN PATENT DOCUMENTS

GB 2 065 610 7/1981
JP 61-060547 3/1986

* cited by examiner

*Primary Examiner*—Jerome Grant, II
*Assistant Examiner*—Negussie W Worku
(74) *Attorney, Agent, or Firm*—Fitzpatrick, Cella, Harper & Scinto

(57) ABSTRACT

Present invention relates to a sheet feeding apparatus comprising, feeding means for feeding sheets; and limiting means movable to a limiting position for limiting a front end of the sheets and to an escape position for releasing the limitation. And the sheet feeding apparatus releases the limitation on the front end by the limiting means before the sheets start to be fed.

15 Claims, 11 Drawing Sheets

SHEET FEEDING APPARATUS AND IMAGE FORMING APPARATUS

BACKGROUND OF THE INVENTION

1. Field of the Invention

This invention relates to a sheet feeding apparatus capable of feeding sheets separately sheet by sheet and to a sheet feeding apparatus used for an image forming apparatus such as, e.g., a photocopier or a facsimile machine.

2. Description of Related Art

As a sheet feeding apparatus used for conventional facsimile machines, for example, there is an apparatus for separately feeding sheet by sheet a bundle of original documents mounted on a tray. In such a sheet feeding apparatus, if the bundle of the original documents is placed in an excessively deep portion when the bundle of the original documents are set, the bundle of the original document cannot be separated, and so called "multiple feeding", in which two or more sheets of the original documents are fed at a time, may occur. Therefore, some conventional sheet feeding apparatuses frequently have a mechanism to prevent excessively deep placement of the original documents, to effectuate separation capability for the original document bundle.

In most cases of conventional apparatuses, however, their constitutions were complicated and increased greatly their costs. To solve this problem, a mechanism as set forth in Japanese Unexamined Patent Publication, Heisei, No. 9-58891 and Japanese Unexamined Patent Publication, Heisei No. 9-58892 was proposed as an inexpensive mechanism for preventing the original documents from excessively deep placed.

In the above mechanism, a stopper for preventing excessively deep placement (excessive insertion) of original documents is pivotally moved from a limiting position for limiting front end of the original documents to an escape position for releasing the limitation in utilizing rotation of a conveyance roller, and comes back from the escape position to the limiting position by its weight.

However, the above conventional apparatus did not have any consideration to relation between timing for start of feeding the original documents and timing for releasing the limitation of the stopper. That is, when the separation roller for separately feeding the original documents begins to rotate earlier than release of the limitation at the original documents by the stopper, the front end of the original documents to be fed by the separation roller is pushed onto the stopper located at the limiting position, thereby causing conveyance failures such that the front end of the original documents is folded or that the original documents are fed obliquely.

In a case of such a conventional mechanism, while the conveyance roller rotates, the stopper repeats pivotal movements between the limiting position and the escape position. When a user inadvertently sets the original documents without striking the original documents (specially, thin original documents) to the stopper, the front end of the original documents does not reach the stopper yet (located on an upstream side in the conveyance direction) when the stopper pivotally moved to the escape position upon the start of the feeding of the original documents, and therefore, a situation may occur in which the front end reaches the stopper after the stopper comes down to the limiting position. Under this situation, the front end of the original documents strikes the stopper, a conveyance failure that the front end of the original documents would be folded may occur.

It is an object of the invention to prevent conveyance failures such as folding of sheets or like occurring due to striking of the front end of the sheets to a stopper when or after the sheet conveyance starts.

SUMMARY OF THE INVENTION

A representative structure of the invention to accomplish the above object comprises a feeding means for feeding sheets, and a limiting means movable between a limiting position for limiting a front end of the sheets and an escape position for releasing the limitation, wherein the limiting means releases the limitation on the front end of the sheets before the sheets start to be fed.

According to the above structure, before the sheets start to be fed, the limiting means releases the limitation on the front end of the sheets, so that conveyance failures such that the front end of the sheets is folded may be prevented.

Since the limiting means is moved to the escape position before the sheets start to be fed, start timing of feeding the sheets can be delayed by providing a delaying means between a driving means and a first feeding means. More specifically, the delaying means is constituted of two rotary members, in which projections arranged in the same track on a surface facing with each other are engaged to transmit drive force from a drive source, as well as in which the projections arranged at two rotary bodies have a play between the projections for delaying the start of drive by means of the play.

According to the above structure, the limiting means releasing the limitation on the front end of the original documents is held in a state to release the limitation until that the front end of the sheets is fed at least on the downstream side in the conveyance direction of the limiting means. Therefore, for example, even if a user inadvertently sets sheets (particularly, thin sheets) as not reaching the limiting means, the apparatus can prevent conveyance failures such that the front end of the sheets is fold upon striking the limiting means.

More specifically, for example, as the feeding means, it is constituted of a first feeding means for separately feeding sheet by sheet sheets inserted from an insertion opening, and a second feeding means arranged on the downstream side in the conveyance direction of the first feeding means for starting rotation earlier than the first feeding means, and the limiting means is movable to the escape position for releasing the limitation on the front end in accordance with the rotation of the second feeding means, so that the apparatus, though with a simple structure, can receive the above advantages.

The limiting means is a pivotal member that can make pivotal upward movements and is moved pivotally to the escape position located on an upper side in accordance with the rotation of the second feeding means and moved down to the limiting position by its weight, so that the apparatus can realize switching of limiting and releasing modes for the front end of sheets with such a simple structure.

The limiting means is a pivotal member having a limiting portion on the upstream side in the conveyance direction of a pivotal shift and having a protecting portion on the downstream side in the conveyance direction. When a projecting portion of the second feeding means pushes down the projecting portion, the limiting portion of the limiting means is pivotally moved to the upper escape position, and the projecting portion of the second feeding means pushes down the projecting portion of the limiting means before the start of the sheet conveyance and continuously pushes down the projecting portion of the limiting means until that at least the front end of the sheets is fed on the downstream side in the conveyance direction of the limiting means. With this structure, the apparatus can reduce the number of parts and the costs and, with such a simple structure, prevent conveyance failures such that the front end of the sheets is fold upon striking the limiting means.

Moreover, an image forming apparatus having at least a reading means for reading images on sheets to be read is characterized in having the sheet feeding apparatus thus structured as a feeding means for feeding sheets to be read to the reading means.

DETAILED DESCRIPTION OF PREFERRED EMBODIMENTS

Figure 1:
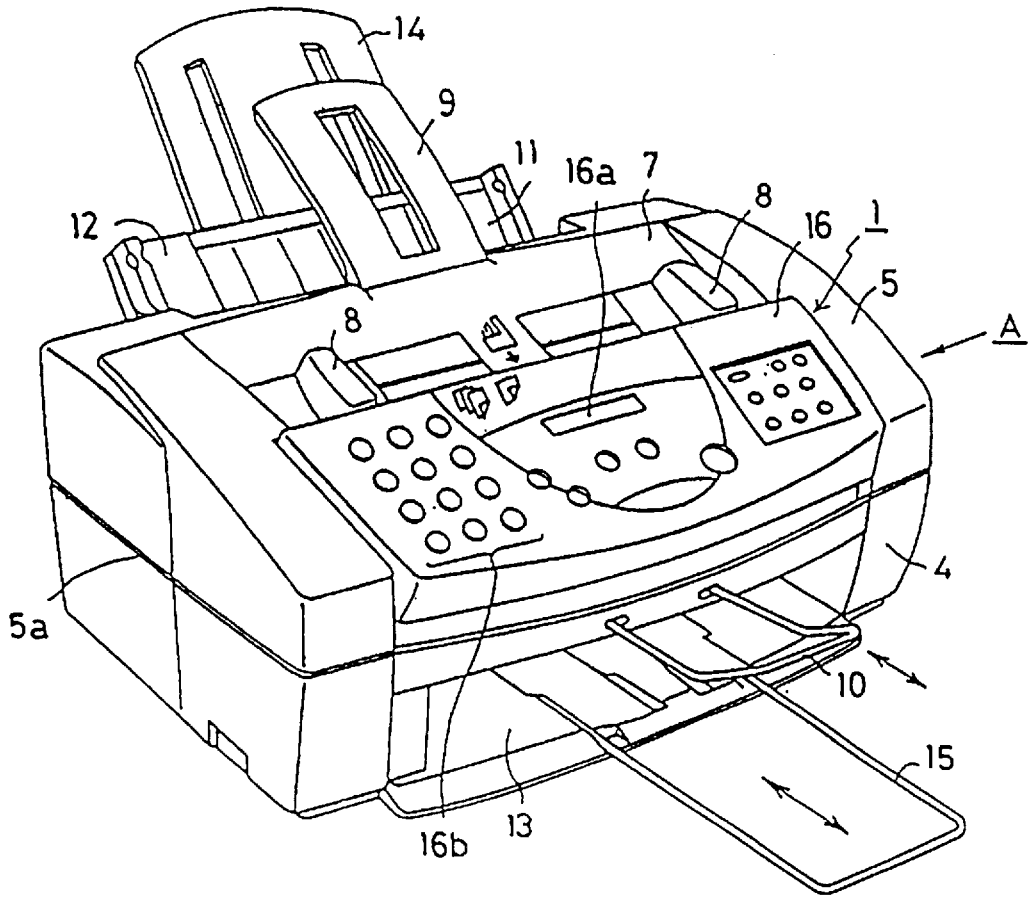
FIG. 1 is a perspective view showing a configuration of a facsimile machine having original document feeding apparatus according to a first embodiment.

Hereinafter, referring to the drawings, embodiments of sheet feeding apparatuses to which this invention applies is described. In the following description, sheet feeding apparatuses are exemplified as for an image forming apparatus such as a photocopier, a facsimile machine, or the like.

[First Embodiment]

Referring to FIGS. 1 to 11, a sheet feeding apparatus according to the first embodiment will be described in detail. In this embodiment, an original document feeding apparatus used for a facsimile machine as an image forming apparatus is exemplified for an explanation.

Figure 2:
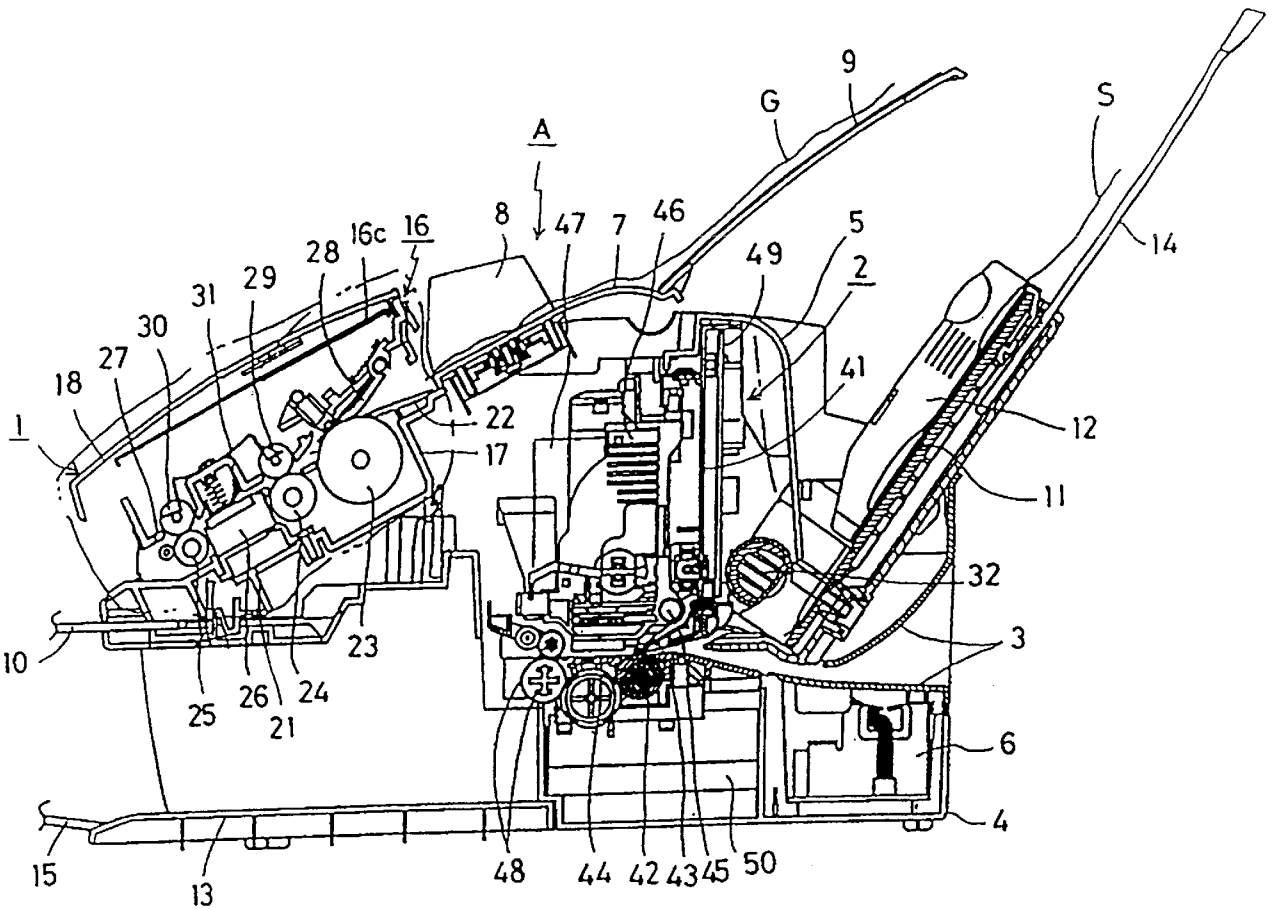
FIG. 2 is a side cross-sectional view showing the facsimile machine shown in FIG. 1.

First, referring to FIGS. 1, 2, an outline of the structure of the facsimile machine is described. FIG. 1 is a perspective view of the appearance of the facsimile machine according to this embodiment; FIG. 2 is a schematic cross-sectional view roughly showing a structure of the facsimile machine according to this embodiment.

In FIGS. 1, 2, A represents a facsimile machine, and in a housing constituting side walls located on right, left, front, and rear sides, incorporated are a scanner unit 1 serving as an reading apparatus for reading images as feeding original documents, a printer unit 2 serving as a recording apparatus for performing serial recording as feeding recording sheets, a control panel, not shown, connected to those for controlling in a prescribed manner, and a power source 3. Those units are separately formed as to be replaceable and removal easily.

The housing is basically formed of a lower cover 4 serving as a first housing on a lower side, an upper cover 5 serving as a second housing on an upper side, and a rear cover 6 serving as a third housing as described below for guiding the recording sheets and for covering the power source.

An original document tray 7 for mountable of multiple number of original documents as sheets to be read is pivotably supported on the upper cover 5 and allows accesses to a recording head as described below. A slider 8 for adjusting width for guiding in respect to a width direction perpendicular to the conveyance direction is formed on the original document tray 7, and the slider 8 can make both sides move in the same way with respect to the middle portion of the slider as a center by moving only one side.

A detachable original document tray 8 is formed on the original document tray 7, and when, for example, original documents of A size are fed toward the scanner unit 1, the tray 9 prevents the read end of the original documents from curving downward. The original documents fed to the scanner unit 1 are placed on an original document delivery tray 10 upon delivered in front of the facsimile machine A after images are read. The original delivery tray 10 is movable in the front and rear direction (arrow direction in FIG. 1).

Meanwhile, recording sheets as sheets of recording objects are set on a recording sheet tray 11 arranged at the rear of the facsimile machine A, and after positionally limited in the width direction by side guides 12 for adjusting width formed on the recording sheet tray 11, the recording sheets are fed sheet by sheet to the printer unit 2. After images are recorded at the printer unit 2 (serial recording), the recording sheets are delivered on the a recording sheet delivery tray 3 located below the scanner unit 1.

The recording sheet tray 11 incorporates a recording sheet support 14 for preventing the recording sheets from curving down, and the recording sheet support 14 is constituted to take the position shown in FIG. 1 by pulling it properly. Similarly, also on the recording sheet delivery tray 13, a recording sheet support bar 15 is formed to prevent the recording sheets from curing downward, and the recording sheets support bar 15 is movable in the front and rear direction (arrow direction in FIG. 1) in the same way as that of the original document delivery tray 10.

The upper cover 5 has a shape to enclose the scanner unit 1 as shown in FIG. 1, and by removing the upper cover 5 from the lower cover 4 along an edge 5*a* of the upper cover 5, the scanner unit 1 can be remained on the lower cover 4.

Next, using FIG. 2, each structure of the units will be described in detail.

First, the scanner unit 1 is described. This scanner unit 1 is to radiate light on the original document G, to convert the reflected light to electrical signals, and to transmit the signals to other machines or the printer unit 2 within the apparatus depending on a control mode.

At a scanner body 17, numeral 21 is a scanner base as a frame for the scanner unit 1 and fixed to the lower cover 4. A lower original document guide 22 for guiding a lower side of the original documents G, a separation roller 23 for sending the original documents, a feeding roller 24 for feeding the original documents, a delivery roller 25 for delivering the original documents on the original document delivery tray 10, a color contact sensor 26 for reading image information of the original documents are formed on the scanner base 21.

A panel portion 16 is connected to the scanner body 17 as to be open and closed with respect to the scanner body 17 around a hinge as a center. The panel portion 16 is formed with an upper original document guide 27 for guiding the upper side of the original documents, a separator 28 pushed by the separation roller 23, a feeding roller 29 pushed by the feeding roller 24, a delivery roller 30 pushed by the delivery roller 25, and white member for reading 31 pushed by the color contact sensor 26 serving as white reference for reading.

Numeral 18 is a panel frame, a part of the housing, attached to the upper original document guide 27, formed with a display 16*a* such as LCD or the like, control keys 16*b* such as control dial keys, and a panel board 16*c* mounting those thereon.

It is to be noted that original document feeding, reading operation, and the like of the scanner unit 1 is done by a motor, sensors, drive circuits, which are not shown, and the control board controls those controls and display controls of the panel portion 16.

Next, the printer unit 2 is described. The recording sheets S mounted on the recording sheet tray 11 (and the recording sheet support 14) are fed sheet by sheet by a feeding roller 32 while restricted on its position in the width direction by side guides 12 and sent to the printer unit 2.

The printer unit 2 uses an ink jet recording method in which ink is sprayed from a recording head to record ink images on the recording sheets. In this printer unit 2, numeral 41 is a printer chassis serving as a frame for printer unit 2, fixed to the lower cover 4. Numeral 42 is a transfer roller for feeding the recording sheets S sent from the sheet feeding section, by pressure of a pinch roller 43 arranged as to correspond to it, to the recording section located on the further downstream side. Numeral 44 is a platen supporting the back surface of the recording sheets at the recording section. On the front surface of the recording sheets, recording images are formed by the recording head 47 attached to a carriage 46 reciprocally traveling supported on a guide shaft 45. Subsequently, the recording sheets S is delivered from the printer unit 2 by the delivery roller pair 48, and placed on the recording sheet delivery tray 13 formed on the lower cover 4.

It is to be noted that recording sheet conveyance, recording operation, and the like of the printer unit 2 can be done by a motor, sensors, a head drive circuit or the like, which are not shown, and the control board controls those members. A board 49 is a recording relay board for relaying signals for the motor, sensors, and head drive circuit and transmitting them to the control board. An absorber 50 for absorbing waste ink generated during preventive operation of ink clogging is attached to the lower cover 50.

Figure 3:
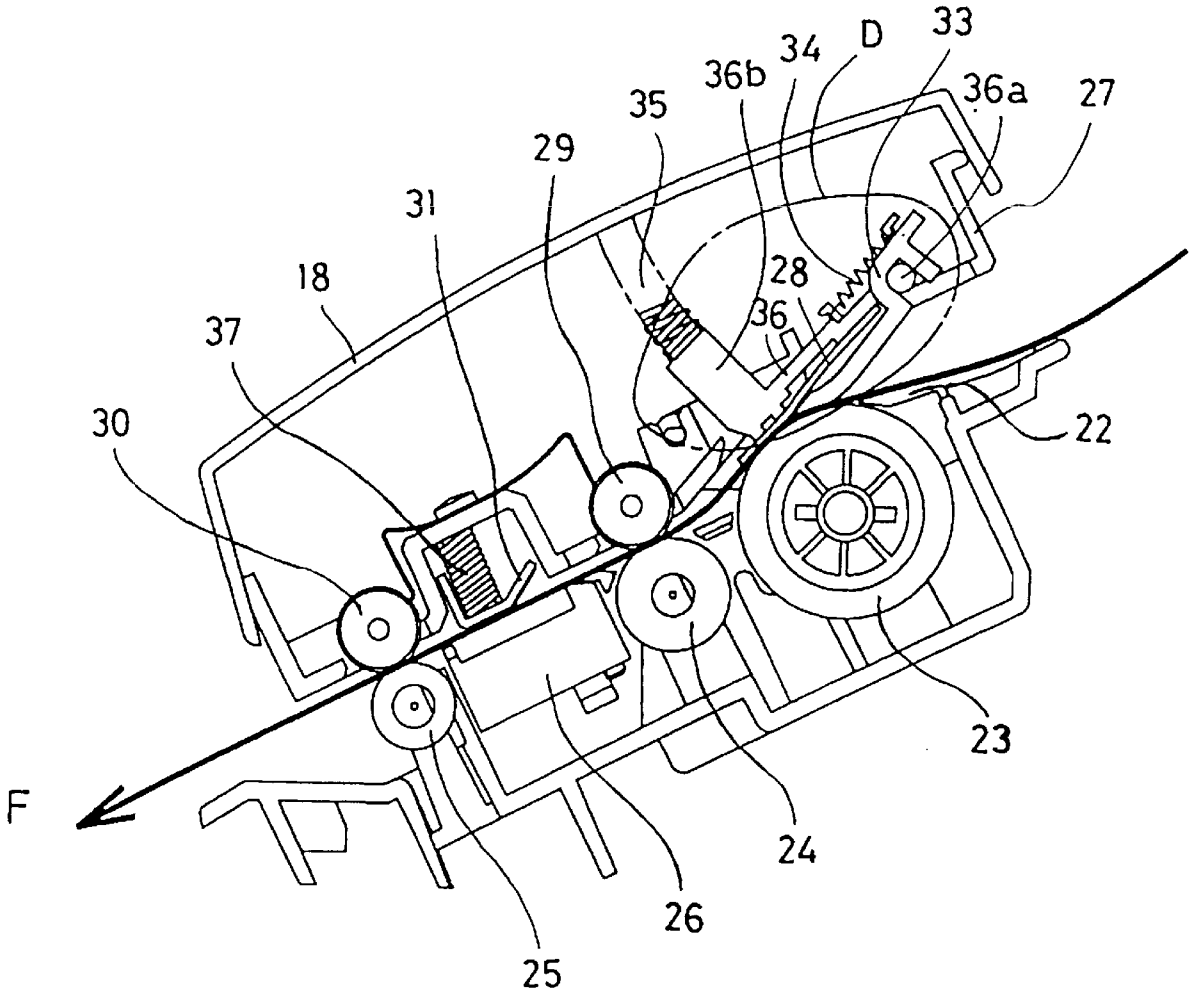
FIG. 3 is an enlarged side cross-sectional view showing an original document feeding system.

A flow of original documents G in the scanner unit 1 is described next. FIG. 3 is an enlarged cross section of the scanner unit 1. The original documents G are set in an original document opening formed between the upper original document guide 27 and the lower original document guide 22, and are fed along a conveyance route shown by Arrow F. In FIG. 3, numeral 33 is a preliminary feeding arm located as to oppose to the separation roller 23. The preliminary feeding arm 33 is pushed to the separation roller 23 by a preliminary feeding spring 34. Therefore, the original documents G set on the tray 7 are handled by joint operation of the preliminary feeding arm 33 and the separation roller 23 and preliminarily fed. By joint operation of the separator 28 pushed to the separation roller 23 by an ADF (auto document feeder) spring 35 and of the separation roller 23, the preliminarily fed original documents G are fed separately sheet by sheet from their bottom. The separation roller 23 can serve for feeding the original documents G to the feeding roller 24. The original document G fed by the separation roller 23 is further fed to a reading position of the contact sensor 26 by the feeding rollers 24, 29, and the contact sensor 26 reads images. At that time, the original document G is in closely contact with a reading line of the contact sensor 26 by means of a reading white ground (white ground metal plate) 31 pushed by a white ground spring 37. The original document G, whose images are read by the contract sensor 26, is delivered on the original document delivery tray 10 by the delivery rollers 25, 30.

Figure 4:
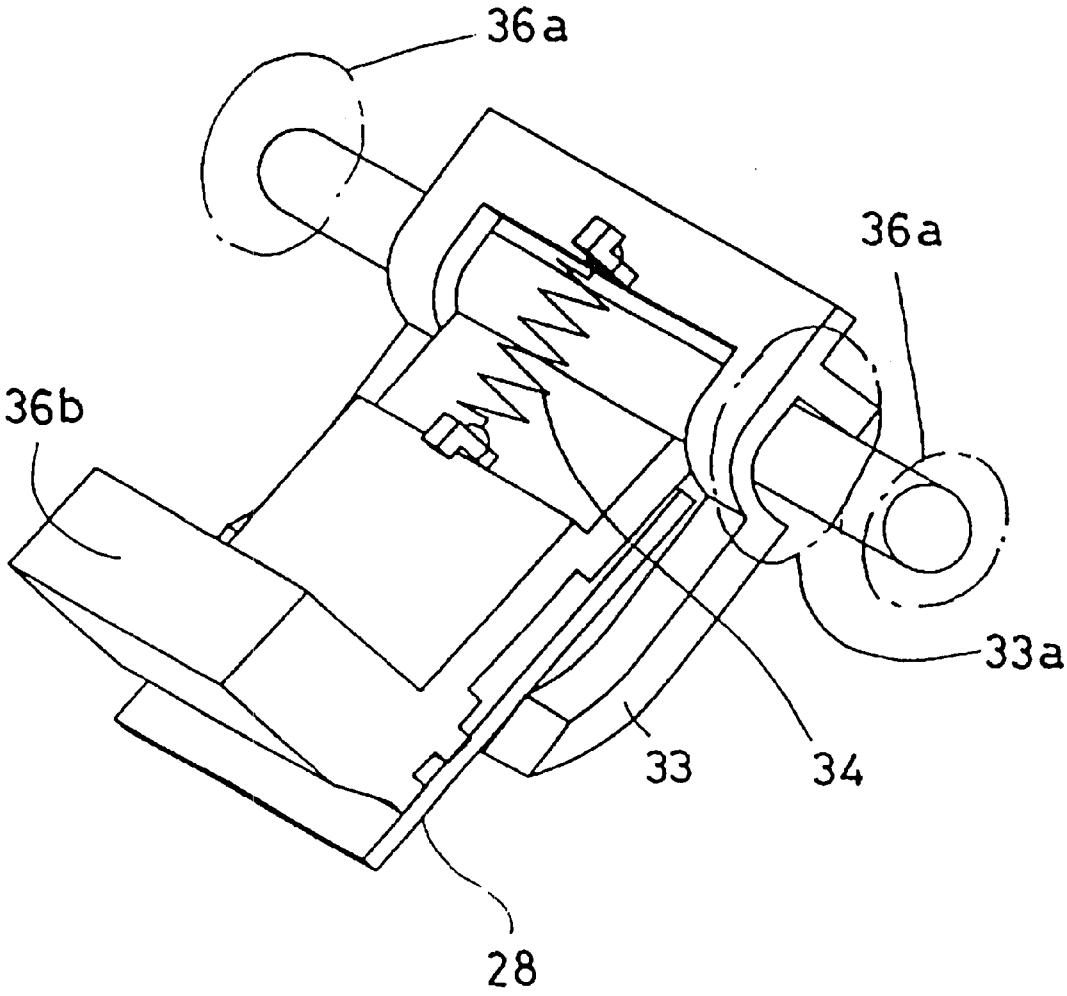
FIG. 4 is a vertical perspective view showing the constitution of a separation unit in the original document feeding system.

A separation section (D portion in FIG. 3) in an original document feeding system in the scanner unit 1 will be described next. FIG. 4 shows an enlarged view of the separation section. In FIG. 4, numeral 28 is the separator made of a frictional member such as a rubber piece and is attached onto an ADF holder 36. Numeral 33 is the preliminary feeding arm, which is made of a plastic member having a relatively small friction coefficient. A projection shaft 36*a* is formed on the ADF holder 36; a U-shaped portion 33*a* is formed on the preliminary feeding arm 33; the projection shaft 36*a* of the ADF holder 36 is attached to a recess of the U-shaped portion 33*a*. The preliminary feeding arm 33 is pivotally movable around the U-shaped portion 33*a* as a center. Numeral 34 is a preliminary feeding spring and coil spring. One end of the preliminary feeding spring 34, between both ends, is engaged with a projection of the preliminary feeding arm 33, and the other is engaged with a projection of the ADF holder 36.

A U-shaped portion, not shown, is formed on the upper original document guide 27, and the projection shaft 36*a* of the ADF holder 36 is attached to a recess of the U-shaped portion. The ADF holder is pivotably movable around the projection shaft 36*a* as a center. The ADF holder 36 is located as to oppose to the separation roller 23 and is disposed so that the preliminary feeding arm 33 and the separator 28 are in contact with the separation roller 23. A receiving surface of the ADF holder 36 is engaged with one end of the ADF spring 35, and the other end of the spring 35 is engaged with the panel frame 18. The ADF spring 35 is a contracted coil spring, and since its elastic force is larger than elastic force of the preliminary feeding spring 34 on the ADF holder 36, the preliminary feeding arm 33 is pushed by the separation roller 23 by operation of the ADF spring 35 and the preliminary feeding spring 34.

Figure 5:
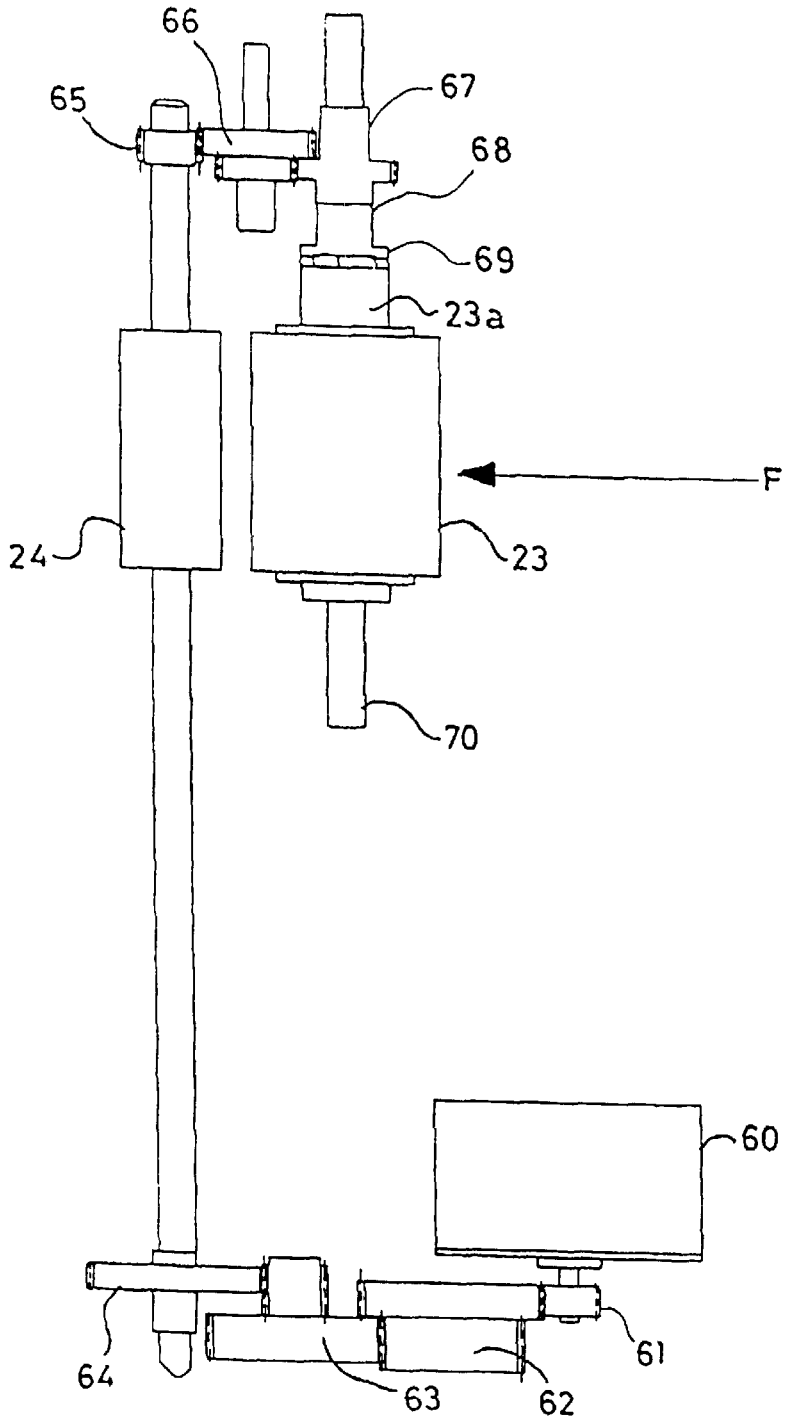
FIG. 5 is an illustration showing a layout of a separation roller, a feeding roller, a reading drive motor, and a gear series in a scanner unit.

A drive system in the scanner unit 1 will be described next. FIG. 5 is a schematic view showing a layout of the separation roller 23, the feeding roller 24, a reading drive motor and gear series. Arrow F in the drawing is the conveyance direction of the original documents. Numeral 60 is a reading drive motor and is a stepping motor driven upon supply of a pulse current. A motor gear 61 is attached to a tip of the reading drive motor 60, and drive torque generated at the reading drive motor 60 is transmitted through the motor gear 61. Numerals 62, 63 are intermediate gears, gears for transmitting the drive torque from the reading drive motor 60 to the feeding roller 24, and two staged gears constituted of two gears having different tooth number from one another. Numerals 64, 65 are separation feeding gears, commonly having a D-shaped center hole. Both ends of the shaft of the feeding roller have a D-shape; the separation feeding gear 64 is attached to the D-shape portion of the end on the reading drive motor 60; the separation feeding gear 65 is attached to the D-shaped portion of the other end. The drive torque generated at the reading drive motor 60 is transmitted from the motor gear 61 to the separation feeding gear 64 through the intermediate 62, 63, thereby rotating the feeding roller 24. The gears 61 to 64 are a gear series for rotating the feeding roller 24.

Numeral 66 is a separation intermediate gear; numeral 67 is a separation gear; and gears 65 to 67 are a gear series for rotating the separation roller 23. The separation feeding gear 65 rotates, by rotation of the feeding roller 24, in the same direction, and the drive torque is transmitted to the separation gear 67 through the separation intermediate gear 66. Numeral 68 is a spring clutch; numeral 69 is a clutch collar; and numeral 70 is a separation shaft. The separation roller 23, the separation gear 67, and the clutch collar 69 are freely rotated around the separation shaft 70 as a center.

Figure 6A:
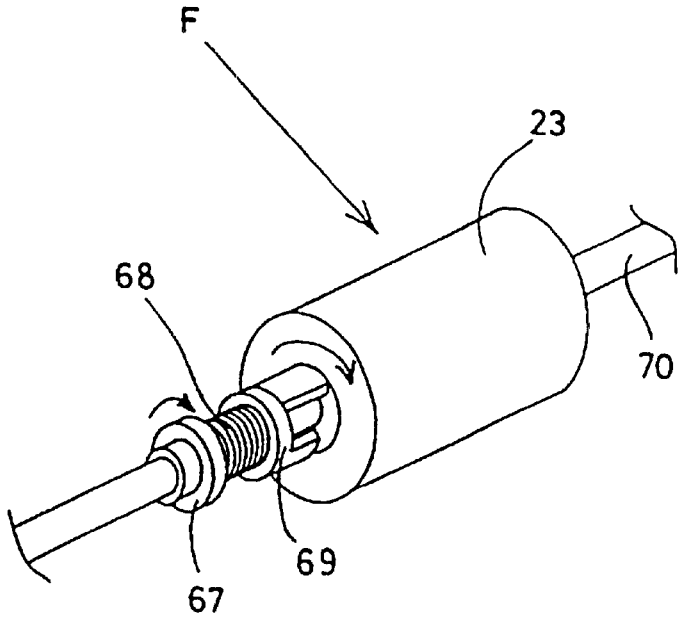
FIG. 6 which includes 6(*a*) and 6(*b*) is an illustration showing the constitution of a separation roller, a spring clutch, and a clutch collar.
Figure 6B:
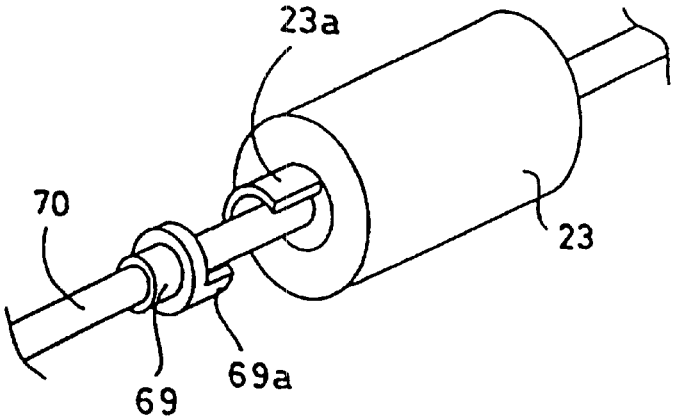
Figure 7A:
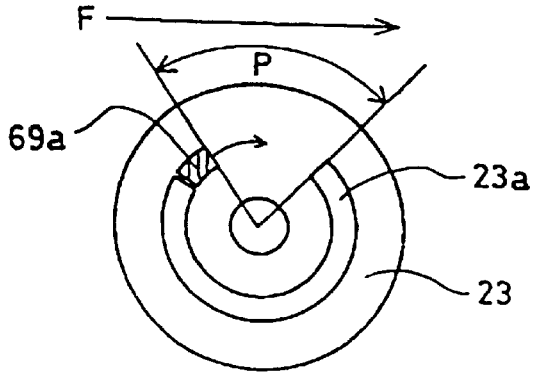
FIG. 7 which includes 7(*a*)–7(*d*) is an illustration for describing operation of the separation roller and the clutch collar.
Figure 7B:
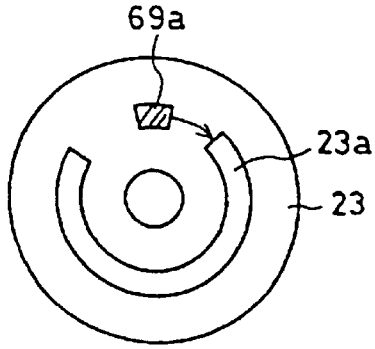
Figure 7C:
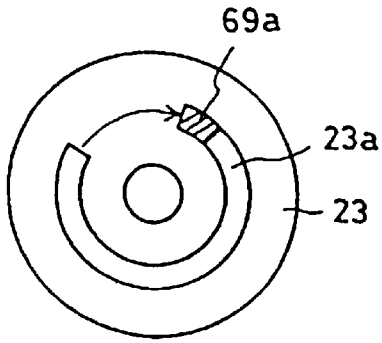
Figure 7D:
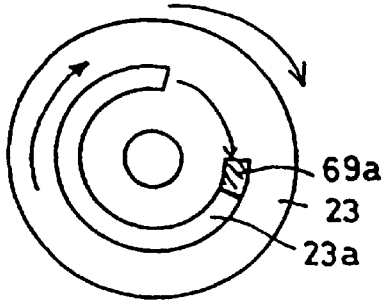

The constitution of the separation roller 23, the spring clutch 68, and the clutch collar 69 is described in reference to FIG. 6. In FIG. 6(*a*), Arrow F in the drawing is the conveyance direction of the original documents, and the other arrow is a rotary direction of the separation roller 23, the clutch collar 69, and the separation gear 67 while the original documents are fed. The spring clutch 68 transmits its drive torque to the clutch collar 69 when the separation gear 67 rotates in the conveyance direction of the original documents. The separation gear 67, the spring clutch 68, and the clutch collar 69 constitute a spring clutch mechanism in which the drive torque transmitted through the separation intermediate gear 66 from the separation feeding gear 65 is transmitted only when rotating in the conveyance direction of the original documents (normal direction). The clutch collar 69 is formed with a projection 69*a*, and the separation roller 23 is formed with a projection 23*a*. The torque is transmitted where the projection 69*a* of the clutch collar 69 rotates in the conveyance direction of the original documents and engages with the projection 23*a* of the separation roller 23, thereby rotating the separation roller 23 in the conveyance direction of the original documents.

FIG. 6(*b*) is an exploded view as for relation between the projection 23*a* of the separation roller 23 and the projection 69*a* of the clutch collar 69. As shown in the drawing, both are engaged with each other around the separation shaft 70 as a center so that the projection 69*a* of the clutch collar 69 meshes a cutout of the projection 23*a* of the separation roller 23. Both projections 23*a*, 69*a* are on the same rotary track around the separation shaft 70 as a center, and the projection 69*a* on the side of the clutch collar 69 is pivotally moved to contact with the projection 23*a* of the separation roller 23. Between both projections 23*a*, 69*a*, a play exists in the rotary track direction.

It is to be noted that the clutch collar 69 constitutes a first rotary member, whereas the end of the separation roller 23 constitutes a second rotary member, and the clutch collar 69 and the end of the separation roller 23 constitute a delaying means.

Operation of the separation roller 23 and the clutch collar 68 will be described next in reference to FIG. 7. As describe above, the separation roller 23 is formed with the projection 23*a*, and the clutch collar 69 is formed with the projection 69*a*. The projection 69*a* of the clutch collar 69 is indicated with hatching in FIG. 7.

FIG. 7(*a*) shows waiting positions of the projection 69*a* of the clutch collar 69 and the projection 23*a* of the separation roller 23 at a state that the reading drive motor 60 does not start yet rotating, namely, the initial state. P represents a space between the projection 69*a* of the clutch collar 69 and the projection 23*a* of the separation roller 23. When a pulse current is supplied to the reading drive motor 60, and when the separation gear rotates in the conveyance direction of the original documents, the drive torque is transmitted through the spring clutch 68 to the clutch collar 69, and the clutch collar 69 starts to rotate in the conveyance direction of the original documents, so that the projection 69*a* also rotates (move) in a direction of Arrow in the drawing (see, FIG. 7(*b*)). When the projection 69*a* of the clutch collar 69 engages with the projection 23*a* of the separation roller 23 (see, FIG. 7(*c*)) as further rotating, the drive torque transmitted to the clutch collar 69 is transmitted to the separation roller 23 through the engaged portion of the projection, and the separation roller 23 rotates in the conveyance direction of the original documents (a direction of Arrow in the drawing) (see, FIG. 7(*d*)).

Operation from a time that the reading drive motor 60 starts to drive to a time that the feeding roller 24 starts to rotate and feed the original documents will be described below. Drive torque generated at the reading drive motor 60 is transmitted to the feeding roller 24 through the gear series 61 to 64, and the feeding roller 24 rotates in the conveyance direction of the original documents. According to this, the torque is transmitted to the clutch collar 69 by way of the gear series constituted of the separation feeding gear 65, the separation intermediate gear 66, and the separation gear 67, and the spring clutch 68, the projection 69*a* of the clutch collar 69 travels through the space P located between it and the projection 23*a* of the separation roller 23. At that time, the separation roller 23 does not yet start rotating. The projection 69*a* of the clutch collar 69, as further rotating, engages with the projection 23*a* of the separation roller 23, and the separation roller 23 rotates in the conveyance direction of the original documents upon receiving the torque. The original documents starts to move in the conveyance direction at that time. That is, the separation roller 23 starts to rotate with a delay by a period from the start of the rotation of the feeding roller 24 for the projection 69*a* of the clutch collar 69 travels in the space P, thereby feeding the original documents. This delay timing is determined from the gear ratio of the gear series from the feeding roller 24 to the separation roller 23 and the size of the space (angle) P between the projection 69*a* of the clutch collar 69 and the projection 23*a* of the separation roller 23.

It is to be noted that even if the separation roller 23 end its drive, the original documents are continuously fed by a feeding means located on the downstream side of the conveyance direction. Therefore, even if no drive force is transmitted from the reading drive motor 60, the separation roller 23 rotates together with the conveyance of the original documents and comes back to the home position shown in FIG. 7(*a*) from a state shown in FIG. 7(*d*).

Figure 8:
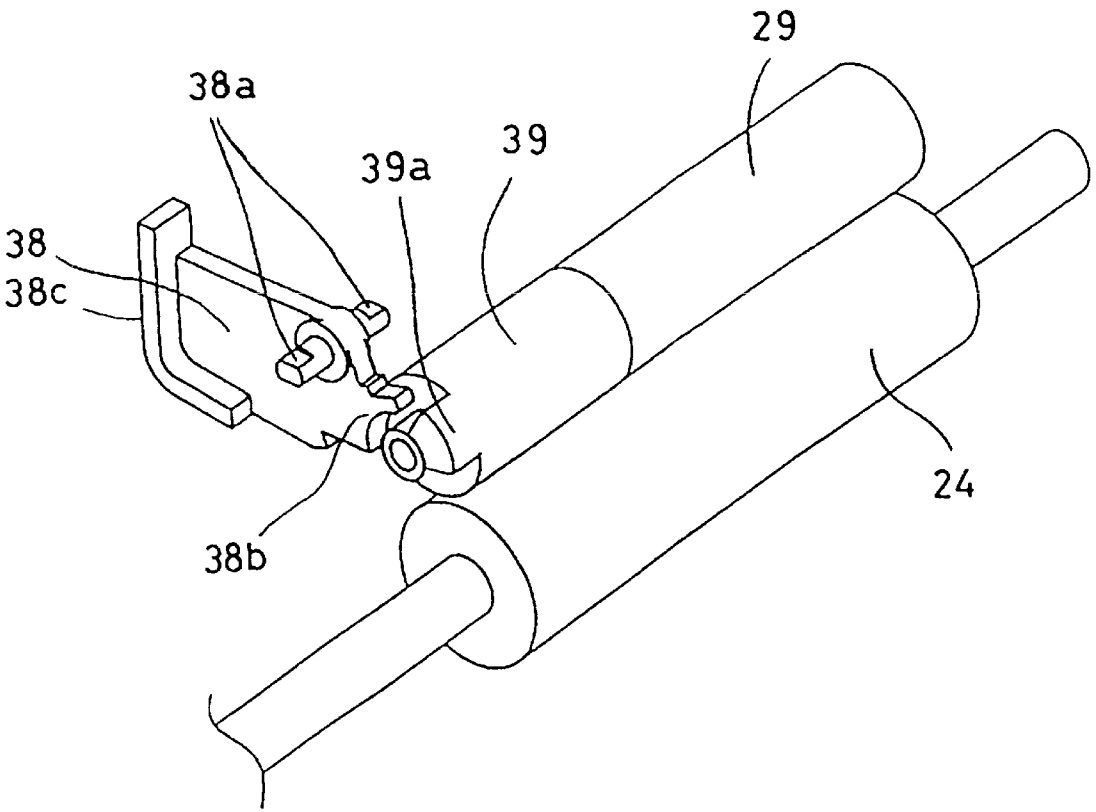
FIG. 8 is an enlarged perspective view of a stopper.
Figure 9A:
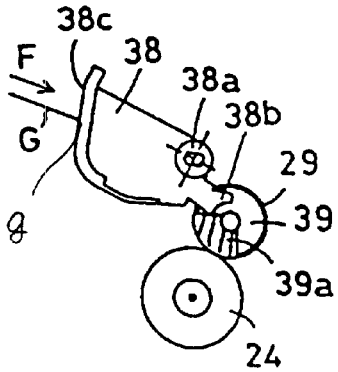
FIG. 9 which includes 9(*a*)–9(*f*) is an illustration for describing operation of the stopper.
Figure 9D:
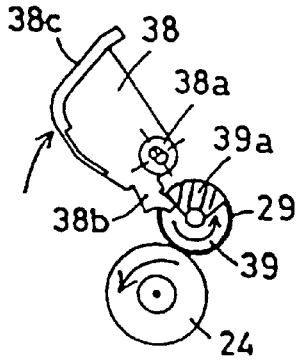
Figure 9B:
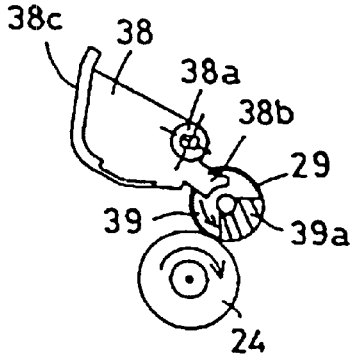
Figure 9E:
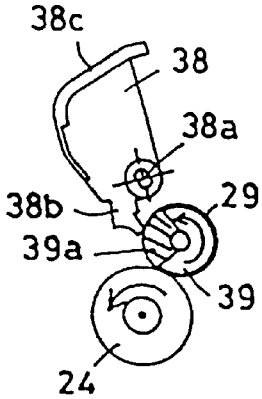
Figure 9C:
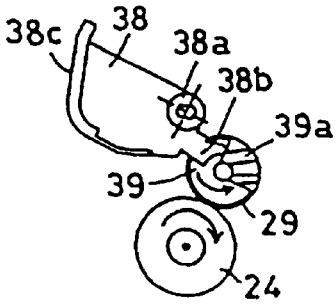
Figure 9F:
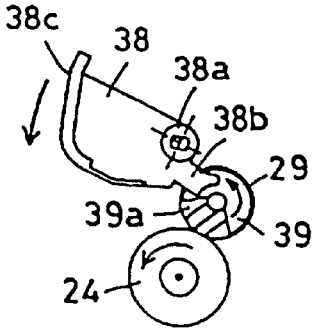

A stopper for preventing excessive insertion of sheets, mounted on tray is described next. FIG. 8 shows a perspective view of the stopper; FIG. 9 shows a side cross section of the stopper. The drawings show a second feeding means constituted of the feeding roller 24 as a driving rotary body and the feeding roller 29, driven to rotate in pressurized contact with the roller 24, serving as a driven rotary body, a stopper roller 39, and a stopper 38 serving as a limiting means pivotable at a limiting position for limiting the front end of the original documents G set on the original document tray 7 and at an escape position for releasing the limitation. The stopper roller 39 has a rib 39 as a united body, which serves as a projection for switching the limitation and the release of the front end of the original documents by means of the stopper 38. The stopper 38 has, as a united body, a projection shaft 38*a*, a projection 38*b* as a projecting portion for engaging with the rib 39*a* of the stopper roller 39, and a stop surface 38*c* as a limiting portion for limiting the front end of the original documents. The stopper 38 is attached to a recess of a U-shaped member, not shown, on the upper original document guide 27 and can freely move pivotally around the projection shaft 38*a* as a center.

Operation of the stopper 38 is described in referring to FIG. 9. At the initial stage, the rib 39*a* of the stopper roller 39 and the stop surface 38*c* of the stopper 38 wait at the limiting position (position shown in FIG. 9(*a*)) for limiting the front end of the original documents. When the feeding roller 24 rotates in the conveyance direction (direction of Arrow), the feeding roller 29 and the stopper roller 39 are also driven to rotate in the conveyance direction (direction of Arrow) (see, FIG. 9(*b*)). The rib 39*a* of the stopper roller 39 also rotates as well, and the rib 39*a* hits the projection 38*b* of the stopper 38 (see, FIG. 9(*c*)). As the feeding roller 24 further rotates, the rib 39*a* of the stopper roller 39 driven to rotate pushes down the projection 38*b* of the stopper 38. The stop surface 38*c*, which has been limiting the front end of the original documents G around the projection shaft 38*a* of the stopper 38 as a center, is lifted up, thereby rendering the limitation on the front end g of the original documents G released (see, FIG. 9(*d*)). While the projection 38*b* of the stopper 38 is above the rib 39*a* of the stopper roller 39, the stopper 38 is held at a state that the stop surface 38*c* is lifted (escaped to the escaping position) (see, FIG. 9(*e*)). When the rib 39*a* of the stopper roller 39 passes through the projection 38*b* of the stopper 38, the stop surface 38 is lowered by the weight of the stopper 38 and comes back to the limiting position (see, FIG. 9(*f*)).

While the feeding roller 24 rotates in the conveyance direction of the original documents, the stop surface 38*c* of the stopper 38 repeats to move up and down pivotally around the projection shaft 38*a* as a center.

The timings that the separation roller 23 starts rotating and that the stopper 38 releases the front end of the original documents are determined by the gear series located between the feeding roller 24 and the feeding roller and the size of the space P between the projection 69*a* of the clutch collar 69 engages with the projection 23*a* of the separation roller 23. However, the space P is a mechanism to determine an interval between the original documents when multiple original documents are fed. Furthermore, the gear ratio (tooth number) of the gear series is determined at a designing state where the torque transmission from the feeding roller 24 and the original document interval are decided, and it is hard to change the ratio later in order to adjust the timing of the conveyance start.

Figure 10:
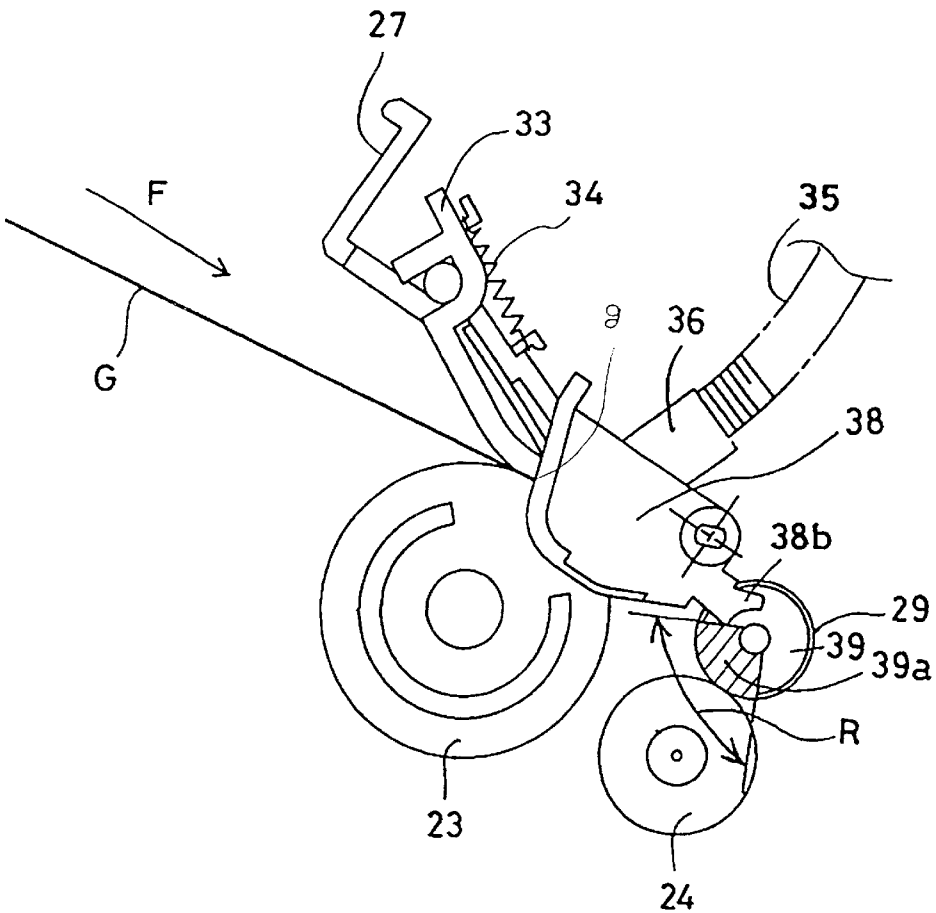
FIG. 10 is an enlarged cross section showing the stopper.
Figure 11A:
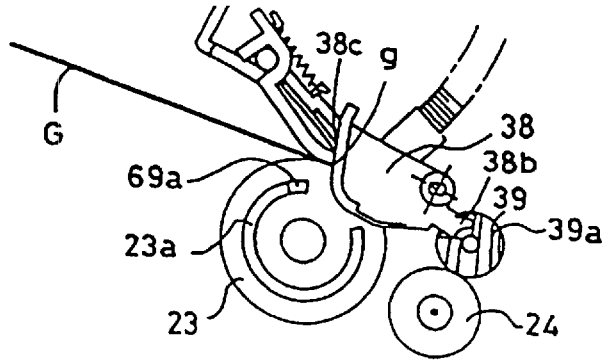
FIG. 11 is an illustration for describing operation of the stopper in showing relation of timings of the limitation and release of the stopper and timing of the start of feeding original documents.
Figure 11B:
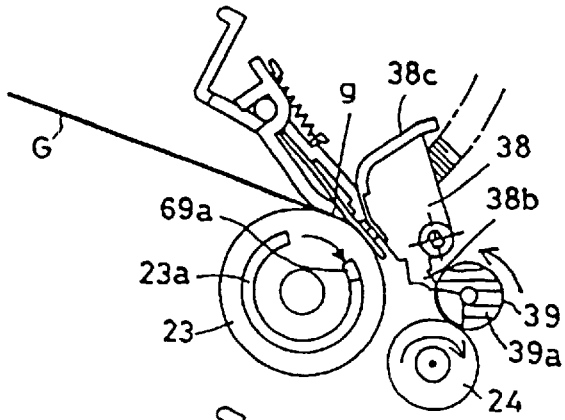
Figure 11C:
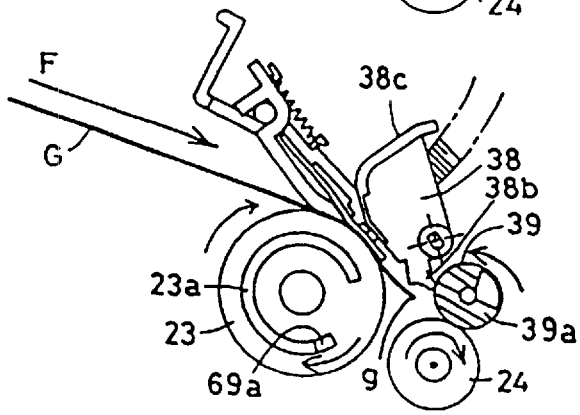
Figure 11D:
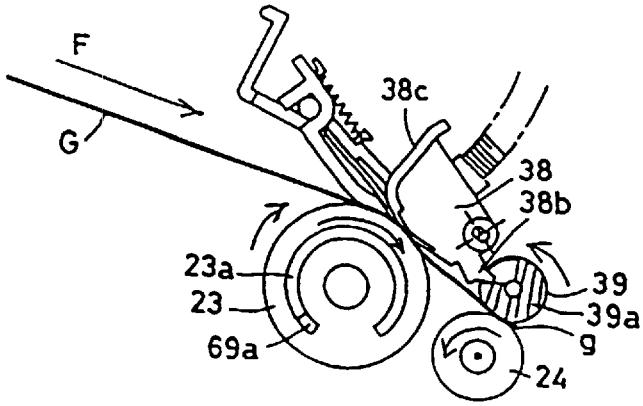

As shown in FIG. 10, to solve this problem, the timing that the stopper 38 releases the limitation on the front end g of the original documents is made earlier than the start of rotation of the separation roller 23 by adjusting the size (angle R) of the rib 39*a* of the stopper roller 39. In FIG. 10, R is the size (angle) of the rib 39*a* of the stopper roller 39, and the timing that the stopper 38 releases the limitation on the front end g of the original documents G can be adjusted easily by changing the angle R. The projection 38*b* of the stopper 38 and the rib 39*a* of the stopper roller 39 constitute a cam mechanism.

Referring to FIG. 11, relation between timings that the separation roller 23 starts rotating and that the stopper 38 releases the limitation on the front end g of the original documents G. In FIG. 11, the hatching area indicates the rib 39*a* of the stopper roller 39. FIG. 11(*a*) shows an initial state when original documents are set on the original document tray 7. In the drawings, G represents the set original documents; g represents the front end of the original documents; the hatching area is the rib 39*a* of the stopper roller 39. The front end g of the original documents G is set upon hitting the stop surface 38*c* of the stopper 38.

From this situation, if a user pushes a start button to make photocopies or transmission, a pulse current is supplied to the reading drive motor 60. Drive torque generated at the reading drive motor 60 is transmitted to the feeding roller 24 through the gear series, and the feeding roller 24 starts rotating in the conveyance direction of the original documents. The feeding roller 29 and the stopper roller 39 also rotate as following to the feeding roller 24, and the rib 39*a* of the stopper roller 39 also starts rotating in the same direction. When the rib 39*a* of the stopper roller 39 pushes down the projection 38*b* of the stopper 38, the stop surface 38*c* moves up to the escape position around the projection shaft 38*a* as center, thereby releasing the front end of the original documents. The angle R of the rib 39*a* of the stopper roller 39 is designed to have a size such that the stop surface 38*c* of the stopper 38 move up to the escape position where the feeding roller 24 and the stopper roller 39 even slightly rotate. That is, before the separation roller 23 starts to rotate, the limitation on the front end of the original documents by the stop surface 38*c* of the stopper 38 is released. Accordingly, the apparatus can prevent conveyance failures such that the front end of the original documents is folded by striking the stop surface 38*c* of the stopper 38. Though the projection 69*a* of the clutch collar 69 engages, as further rotating, with the projection 23*a* of the separation roller 23, the separation roller 23 does not yet start rotating when the limitation on the front end g of the original documents is released (see, FIG. 11(*b*)).

As further the feeding roller 24 rotates, the projection 69*a* of the engaged clutch collar 69 transmits the torque to the separation roller 23, so that the separation roller 23 starts to rotate. The original documents G are sent to a contact area between the separator 28 and the separation roller 23 by the preliminary feeding arm 33 and the separation roller 23 which is in pressurized contact with the arm 33 and are separately fed sheet by sheet by means of the separator 28 and the separation roller 23 contacting with pressure. At that time, the stop surface 38*c* of the stopper 38 is held at a moved-up state (escape position) by the rib 39*a* of the stopper roller 39 and continuously releases the limitation on the front end g of the original documents (see, FIG. 11(*c*)). The angle R of the rib 39*a* of the stopper roller 39 is designed to have a size such that the stop surface 38*c* is held at the escape position until that the front end g of the original documents is fed on the downstream side of the stopper 38 in the conveyance direction after the limitation on the front end g of the original documents G set on the stop surface 38*c* in hitting thereon. Therefore, the apparatus can prevent conveyance failures such that the front end of the original documents is folded by striking the stop surface 38*c* of the stopper 38. When the feeding roller 24 and the stopper roller 39 further rotate and when the rib 39*a* of the stopper roller 39 passes through the projection 38*a* of the stopper 38, the stop surface 38*c* of the stopper 38 moves down by its weight. At that time, because the front end g of the original documents has already been fed on the downstream side of the stopper 38 in the conveyance direction, the stopper 38 is placed on the original documents G when the stop surface 38*c* of the stopper 38 moves down (see, FIG. 11(*d*)). Hereinafter, operation shown in FIGS. 11(*b*) to 11(*d*) is repeated to feed a sheet of the original documents G.

Although the above description is for a case where the original documents G are set upon hitting the stop surface 38*c* of the stopper 38, the same operation would be made even where the original documents G are set in front of but not reaching the stop surface 38*c* of the stopper 38. For example, it is conceivable that the original documents are set in a state that the front end of the original documents (particularly, thin original documents) does not reach the stop surface 38*c* of the stopper 38 by an inadvertent user. In such a case, if the angle R of the rib 39*a* of the stopper roller 39 is small, the stop surface 38*c* of the stopper 38 moves down right after moving up. The front end of the original documents still does not reach the stop surface 38*c* of the stopper 38 (on the upstream side in the conveyance direction) even though the original documents start to be fed after the stop surface 38*c* of the stopper 38 moves up to the escape position, and therefore, a situation that after the stop surface 38*c* moves down the front end of the original documents reaches the stop surface 38*c* may occur, thereby creating risks of conveyance failures such that the front end of the original documents is folded.

To solve this problem, the angle R of the rib 39*a* of the stopper roller 39 is designed to have a size such that the stop surface 38*c* is held at the escape position until that at least the front end g of the original documents is fed on the downstream side of the stopper 38 in the conveyance direction. It is to be noted that as the angle R of the rib 39*a* of the stopper roller 39 is made larger, the time in which the stop surface 38*c* of the stopper 38 is held at the escape position is made longer. Therefore, even where the original documents G are set in a state that the front end g of the original documents G does not reach the stop surface 38*c* of the stopper 38, the stop surface 38*c* of the stopper 38 moves up to the escape position, and the stop surface 38*c* of the stopper 38 is held in a state that the stop surface 38*c* of the stopper 38 moves up at the escape position even after the original documents G start to be fed by rotation of the separation roller 23 but until the front end g of the original documents passes by the stopper 38 (see, FIG. 11(*c*)). Accordingly, even in a case above, when the stop surface 38*c* moves down to the limiting position, it is in a situation that the front end g of the original documents is fed on the downstream side of the stop surface 38*c* in the conveyance direction as shown in FIG. 11(*d*), so that the apparatus can prevent conveyance failures such that the original documents is folded due to striking the stop surface 38*c* by the front end g of the original documents.

As described above, according to this embodiment, since the limitation and releasing of the stopper 38 is performed by the rib 39*a* of the stopper roller 39 driven to rotate by rotation of the feeding roller 24, and since the angle R of the rib 39*a* of the stopper roller 39 is designed to have a size that the stopper 38 releases the limitation on the front end of the original documents before the separation roller 23 starts to rotate and that the stopper 38 is held in a state that the limitation is released until the front end g of the original documents is fed on the downstream side of the stopper 38 in the conveyance direction, the apparatus can prevent, with such a simple structure, conveyance failures such that the original documents are folded due to striking the stopper 38 by the front end g of the original documents.

Other Embodiments

Although in the above embodiment, the separation roller 23 and the clutch collar 69 are operably connected with each other by projections having a play, the same advantages can be obtained by setting that one end is made of a projection and the other end is made of a long groove, as a matter of course. In such a case, the end of the long groove works as a projection, so that, in a broad sense, this is no different from power transmission done by projections.

Moreover, although in the above embodiment the feeding roller 29 and the stopper roller 39 are exemplified as separate parts, this invention is not limited to this, and those two parts can be a single united part. With such a structure, the same advantages as above can be obtained, and the apparatus can reduce the costs by reduction of the number of parts.

Although in the embodiment described above, a facsimile machine is exemplified as an image forming apparatus, this invention is not limited to this and can be other image forming apparatuses such as photocopiers or the like, and substantially the same advantages can be obtained by application of the invention to a sheet feeding apparatus used for an image forming apparatus.

In the above embodiment, the ink jet recording method is exemplified as a recording method. This invention is not limited to this, and for example, other recording methods such as electrophotographic methods can be used.

In the above embodiment, exemplified is a case that this invention applies to the feeding system in which the original documents as sheets to be read are fed to a reading means. This invention is not limited to this, and the same advantages can be obtained by application of the invention to a feeding system in which recording sheets as sheets to be recorded are fed to a recording section.

As described above, according to the invention, the apparatus has a structure that the limitation on the front end of the sheets by the limiting means is released before the sheets start to be fed, so that the apparatus can prevent conveyance failures such that the sheets are folded due to striking the limiting means by the front end of the sheets.

The limiting means releasing the limitation on the front end of the sheets has a structure to be held in a state that the limitation is released, until at least the front end of the sheets is fed on the downstream side of the limiting means in the conveyance direction, so that even where the sheets (particularly, thin sheets) are set in not reaching the limiting means by an inadvertent user, the apparatus can prevent conveyance failures such that the sheets are folded due to striking the limiting means by the front end of the sheets.

More specifically, for example, the apparatus is constituted of, as a feeding means for feeding sheets, a first feeding means for feeding separately sheet by sheet sheets inserted from an inlet, and a second feeding means placed in the downstream side of the first feeding means in the conveyance direction for starting rotation earlier than the first feeding means and is constituted that a limiting means moves to an escape position releasing the limitation on the front end of the sheets according to the rotation of the second feeding means, so that the apparatus can obtain the above advantages with a simple structure.

Where the limiting means is a pivotal member movable upward, pivotally moves to the escape position according to the rotation of the second feeding means, and moves down to the limiting position by its weight, the apparatus can realize switching of limitation and release of the front end of the sheets with such a simple structure.

The limiting means is a pivotal member having a limiting portion on an upstream side of the pivotal movement shaft in the conveyance direction and a projection on a downstream side of the shaft in the conveyance direction; the limiting portion is moved pivotally to the escape position upon that the projection of the second feeding means pushes down the projection of the limiting means; the projection of the second feeding means pushes down the projection of the limiting means before the sheets start to be fed and keeps to push down the projection of the limiting means until at least the front end of the sheet is fed on the downstream side of the limiting means on the conveyance direction. The apparatus therefore can reduce the costs by reducing the number of parts and can prevent conveyance failures such that the sheets are folded due to striking the limiting means by the front end of the sheets.

What is claimed is:

1. A sheet feeding apparatus comprising:

first feeding means for feeding separately sheet by sheet sheets inserted from an inlet; and second feeding means placed in a downstream side of the first feeding means in the conveyance direction; and limiting means movable to a limiting position for limiting a front end of the sheets and to an escape position for releasing the limitation, the limiting means moving to the escape position to release the limitation on the front end of the sheets according to starting of the rotation of the second feeding means, wherein after the second feeding means starts rotating, the limiting means moves to the escape position and then the first feeding means starts rotating.

2. The sheet feeding apparatus according to claim 1, wherein the limiting means for releasing the limitation on the front end of the sheets is held in a state that the limitation is released until at least the front end of the sheets is fed on a downstream side of the limiting means in a conveyance direction.

3. The sheet feeding apparatus according to claim 1, wherein the limiting means is a pivotal member pivotally movable from a prescribed limiting position up to a prescribed escape position and pivotally moves upward to the escape position according to the rotation of the second feeding means and downward to the limiting position by the weight of the limiting means.

4. The sheet feeding apparatus according to claim 3, wherein the limiting means is a pivotal member having a limiting portion on an upstream side of the pivotal movement shaft in the conveyance direction and a projection on a downstream side of the pivotal movement shaft in the conveyance direction, and the limiting portion of the limiting means is moved pivotally to the escape position upon that a projection of the second feeding means pushes down the projection of the limiting means.

5. The sheet feeding apparatus according to claim 4, wherein the projection of the second feeding means pushes down the projection of the limiting means before the sheets start to be fed and keeps to push down the projection of the limiting means until at least the front end of the sheet is fed on the downstream side of the limiting means on the conveyance direction.

6. The sheet feeding apparatus according to claim 1, wherein the first feeding means and the second feeding means are pivotally moved upon reception of drive force from the same driving means, and delaying means for delaying start of drive of the first feeding means is arranged between the driving means and the first feeding means.

7. The sheet feeding apparatus according to claim 6, wherein the delaying means includes a first rotary member formed on a side of the driving means and a second rotary member formed on a side of the first feeding means, and projections are formed on the same rotational track on opposing faces of the first and second rotary members, and drive force is transmitted upon engagement between the projections, and the projections have a play between the projections to delay timing of the start of drive of the first rotary member.

8. An image forming apparatus comprising:

reading means for reading images on sheets; and a sheet feeding apparatus as set forth in claim 1 to 7, or 8, for feeding sheets to the reading means.

9. A sheet feeding apparatus comprising:

a separation roller for feeding sheet by sheet sheets from a mounting tray;

limiting means arranged on a downstream side of the separation roller in a conveyance direction of the sheets, moving between a lower limiting position for limiting the sheets from entering further more from a prescribe position in contact with a front end of the sheets and an upper escape position for releasing the limitation;

driving means for providing drive force to the separation roller and the limiting means; and a cam mechanism arranged between the limiting means and the driving means, wherein by adjusting the cam mechanism, the limitation on the front end of the sheets by the limiting means is released before the sheets start to be fed and, wherein said limiting means moves to the escape position a predetermined interval before the separation roller starts rotating.

10. The sheet feeding apparatus according to claim 9, further comprising a feeding roller arranged on the downstream side of the limiting means in the conveyance direction of the sheets for feeding sheets, wherein the cam mechanism is disposed between the limiting means and the feeding roller.

11. The sheet feeding apparatus according to claim 9, further comprising delaying means arranged between the separation roller and the driving means, wherein the delaying means includes a first rotary member formed on a side of the driving means and a second rotary member formed on a side of the separation roller, and projections are formed on the same rotational track on opposing faces of the first and second rotary members, and drive force is transmitted upon engagement between the projections, and the projections have a play between the projections to delay timing of the start of drive of the separation roller.

12. A sheet feeding apparatus comprising:

first feeding means for feeding separately sheet by sheet sheets from a stacked sheet bundle;

second feeding means placed in a downstream side of the first feeding means in a conveyance direction for feeding the sheets fed by the first feeding means;

limiting means movable to a limiting position for limiting a front end of the stacked sheet bundle and to an escape position not limiting the bundle; and moving means for moving the limiting means to the escape position according to rotation of the second feeding means, and before the first feeding means starts to feed the sheets;

wherein after the second feeding means starts rotating, the limiting means moves to the escape position and then the first feeding means starts rotating.

13. The sheet feeding apparatus according to claim 12, wherein the first feeding means and the moving means are driven by a common drive source, and further comprising delaying means for delaying transmission start timing of drive from the drive source to the first feeding means so that the drive of the drive source is transmitted to the first feeding means after the moving means start moving the limiting means to the escape position.

14. The sheet feeding apparatus according to claim 13, wherein the delaying means includes a first rotary body rotated by the drive source, and a second rotary body rotatable synchronously with the first feeding means, and further comprising engaging means for engaging the first and second rotary bodies with each other after the first rotary body rotates for a prescribed angle.

15. The sheet feeding apparatus according to claim 12, 13, or 14, wherein the first feeding means includes a roller for applying conveyance force to sheets by rotation of the first feeding means, and a frictional member disposed as to oppose to the roller, and the limiting means limits a position of the front end of the sheets sandwiched by the roller and the frictional member.

* * * * *

UNITED STATES PATENT AND TRADEMARK OFFICE

CERTIFICATE OF CORRECTION

PATENT NO. : 6,392,763 B1
DATED : May 21, 2002
INVENTOR(S) : Takayuki Nishinohara et al.

It is certified that error appears in the above-identified patent and that said Letters Patent is hereby corrected as shown below:

Column 4,
Line 2, “an” should read -- a --.
Line 7, “removal” should read -- removable --.
Line 40, “a” should be deleted.
Line 48, “curing” should read -- curving --.

Column 6,
Line 12, “closely” should read -- close --.

Column 7,
Line 59, “describe” should read -- described --.

Column 11,
Line 40, “case above,” should read -- case described above, --.

Column 13,
Line 51, “keeps to push down” should read -- keeps pushing down --.

Column 14,
Line 6, “1 to 7,” should read -- 1 to 6, --.
Line 7, “8,” should read -- 7, --.
Line 15, “prescribe” should read -- prescribed --.

Signed and Sealed this

Twenty-ninth Day of October, 2002

*Attest:*

*Attesting Officer*

JAMES E. ROGAN
*Director of the United States Patent and Trademark Office*